United States Patent [19]

Takahashi et al.

[11] Patent Number: 4,739,358

[45] Date of Patent: Apr. 19, 1988

[54] FILM PROCESSOR APPARATUS

[75] Inventors: Hideo Takahashi; Takanari Saitoh, both of Saitama, Japan

[73] Assignee: Sun Seiki Co., Ltd., Japan

[21] Appl. No.: 880,558

[22] Filed: Jun. 30, 1986

[30] Foreign Application Priority Data

Jul. 3, 1985 [JP] Japan ..... 60-101534[U]
Aug. 16, 1985 [JP] Japan ..... 60-125621[U]

[51] Int. Cl.[4] ..... G03D 3/08

[52] U.S. Cl. ..... 354/322; 226/188; 226/194; 384/428; 384/438

[58] Field of Search ..... 354/319, 320, 321, 322; 226/188, 189, 190, 194; 384/295, 428, 438, 439

[56] References Cited

U.S. PATENT DOCUMENTS 3,807,616 4/1974 Hope et al. ..... 226/194
4,086,607 4/1978 Muller ..... 354/322
4,252,429 2/1981 Hope et al. ..... 226/188
4,255,039 3/1981 Hope et al. ..... 354/320
4,327,989 5/1982 Hope et al. ..... 354/322

FOREIGN PATENT DOCUMENTS 2425190 12/1974 Fed. Rep. of Germany .

*Primary Examiner*—A. A. Mathews
*Attorney, Agent, or Firm*—Lowe, Price, LeBlanc, Becker & Shur

[57] ABSTRACT

A plurality of processing tanks each charged therein with a processing liquid includes plural sets of a pair of feed rollers for continuously passing an exposed film through the processing liquid, and gears are fixed to one shaft ends of the upper rollers of said pairs of feed rollers. Above the gears, a driving shaft extends at right angles with said rollers, and includes a plurality of worm gears to engage the respective gears. The driving shaft is rotatably supported on a bearing member detachably mounted on a tank assembly.

10 Claims, 10 Drawing Sheets

FILM PROCESSOR APPARATUS

BACKGROUND OF THE INVENTION

1. Field of the Invention

The present invention relates to a film processor apparatus and, more particularly, to a film processor apparatus which includes a plurality of processing tanks, each being charged with a processing liquid, and plural pairs of rollers respectively mounted within said plurality of processing tanks for continuously passing an exposed film through the processing liquid.

2. Statement of the Related Art

An arrangement of the type as mentioned just above is disclosed in West German Patent No. 2,425,190 specification, for instance. The arrangement includes two sets of a pair of feed rollers in the associated processing tanks. An exposed film is then continuously fed through a processing liquid by the rotation of the rollers. The feed rollers are each fitted over its shaft with a bearing to be fitted into a groove formed vertically in a side wall of each processing tank, and are rotated through gears, which engage the associated worm gears provided on a horizontal driving shaft revolved by a motor.

When the aforesaid driving shaft is disposed below a pair of feed rollers, however, it is adapted to pass through the partitions in the processing liquid. This offers some problems in connection with liquid leakage, durability, etc. Since they are rotatably supported on bearing fixedly provided on the upper position of the said rollers, it is required to attach or detach the feed rollers to or from the processing tanks in a given inclined state to avoid the aforesaid driving shaft for the maintenance or replacement of said feed rollers, so that there is a drop in workability. There is also a possibility that, at the time of attachment or detachment, the bearings for the feed rollers located on the feed side may be inclined and disengage from the given position.

OBJECT AND SUMMARY OF THE INVENTION

An object of the present invention is to provide a film processor apparatus which allows ready attachment or detachment of a driving shaft for driving feed rollers for the purpose of improving the workability of maintenance, replacement, etc. of the feed rollers.

According to the present invention, there is provided a film processor apparatus including a tank assembly comprising a plurality of processing tanks charged therein with a processing liquid, a plurality of pairs of rollers mounted in said tank assembly for continuously passing an exposed film through said processing liquid, and a driving shaft which extends above one shaft ends of the upper rollers of said pairs of rollers and at right angles with respect thereto, and which has worm gears in engagement with gears formed on said one shaft ends, wherein said driving shaft is rotatably supported on a bearing member detachably mounted on said tank assembly.

According to the first embodiment of the present invention, said bearing member includes means to be inserted into a hole formed in a bearing-supporting portion of said tank assembly, a bearing portion integrally provided on an upper portion of said means to be inserted, a resilient locking piece integrally provided on one side of said means to be inserted, and locking means integrally provided on the said resilient locking piece and resiliently locked on stopper means of said hole.

According to the second embodiment of the present invention, said bearing member includes means to be inserted into a hole formed in a bearing-supporting portion of said tank assembly, a bearing portion integrally provided on an upper portion of said means to be inserted, and locking means to engage a locking lever movably supported on said bearing-supporting portion.

According to the third embodiment of the present invention, said bearing member includes a bearing portion integrally provided on a seat plate, first locking means integrally provided at one end of said seat plate to engage a side wall of said tank assembly, and second locking means integrally provided at the other end of said seat plate to engage a locking lever movably supported on said bearing-supporting portion.

According to the fourth embodiment of the present invention, said bearing member includes a bearing portion integrally provided on a seat plate, a hinge portion integrally provided at one end of said seat plate to engage a side wall of said tank assembly, and a locking portion integrally provided at the other end of said seat plate to engage a locking lever movably supported on said bearing-supporting portion.

According to the fifth embodiment of the present invention, said driving shaft has one end supported on a first bearing member rotatably supported on said tank assembly and the other end supported on a second bearing member movably supported on said bearing-supporting portion.

According to the sixth embodiment of the present invention, said driving shaft has one end supported on a first bearing member fixed to said tank assembly and the other end supported on a second bearing member locked on a locking lever movably supported on said bearing-supporting portion, and has one end side connected by means of a pin in a bendable manner.

According to the seventh embodiment of the present invention, said driving shaft has one end supported on a first bearing member fixed to said tank assembly and the other end supported on a second bearing member slidably mounted on said bearing-supporting portion in the axial direction of said driving shaft.

According to the eight embodiment of the present invention, said driving shaft is supported on a bearing member fixed to a hood detachably provided on said tank assembly.

According to the ninth embodiment of the present invention, said driving shaft is supported on a bearing member fixed to a hood rotatably provided on said tank assembly.

DETAILED DESCRIPTION OF THE PREFERRE EMBODIMENTS

The first embodiment of the present invention will now be explained with reference to FIGS. 1 to 5.

Figure 1:
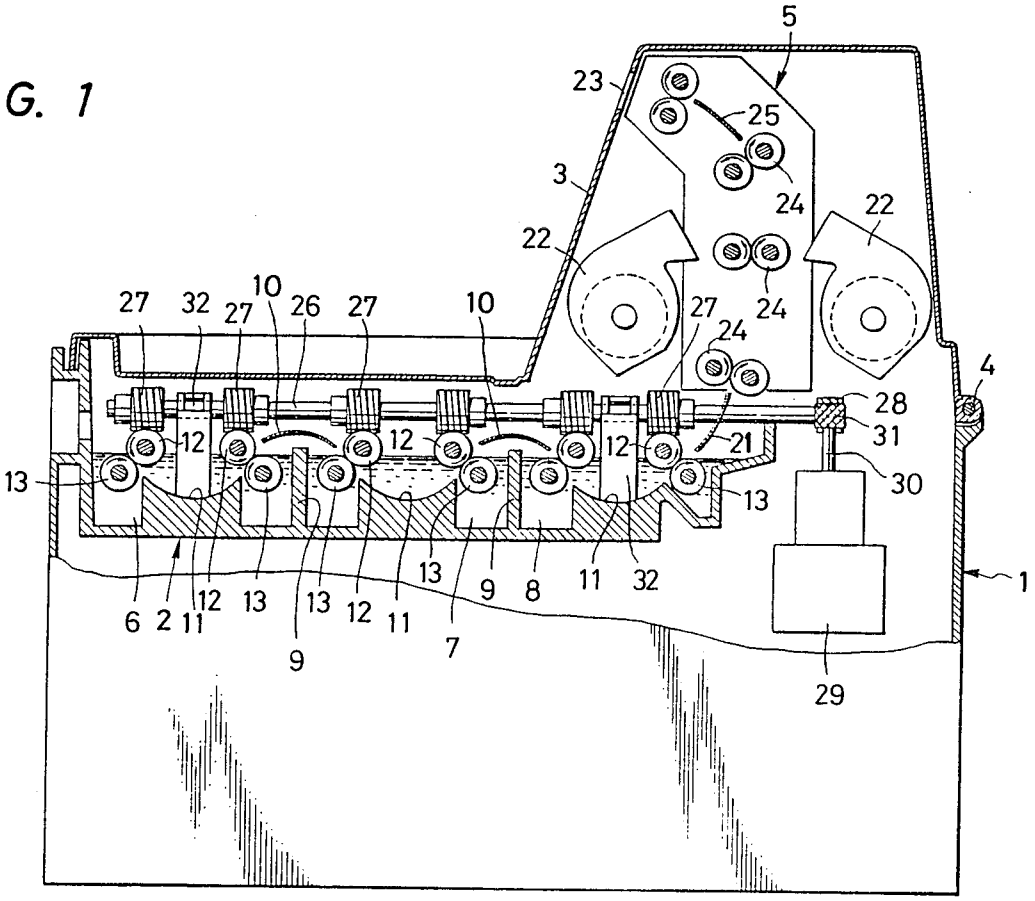
FIGS. 1 to 5 show the first embodiment of the present invention, FIG. 1 being a partly sectioned front view of the film processor apparatus, FIG. 2 being a partial plan view showing the tank assembly of that apparatus, FIG. 3 being a sectioned side view showing the bearing device, FIG. 4 being a perspective view showing the bearing member, and FIG. 5 being a side view illustrating the engagement of the worm gear of the driving shaft with the gear of the feed roller.
Figure 2:
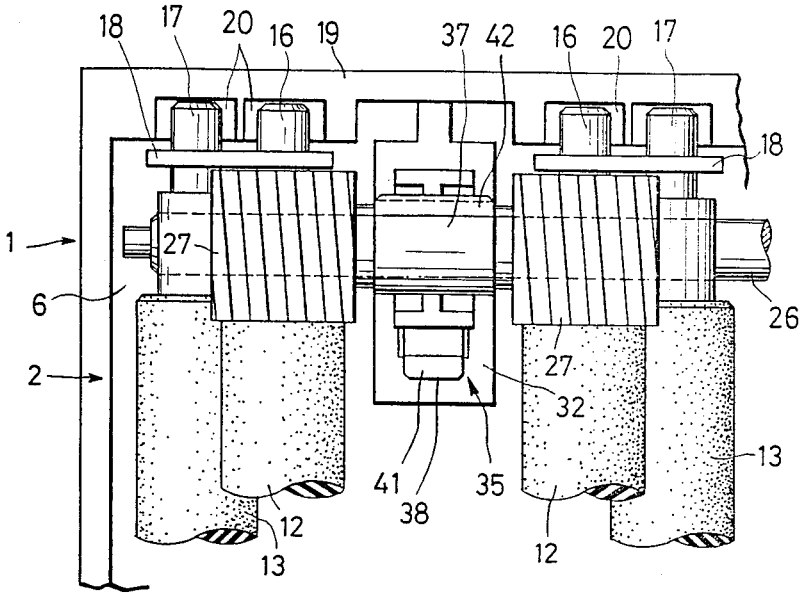
Figure 3:
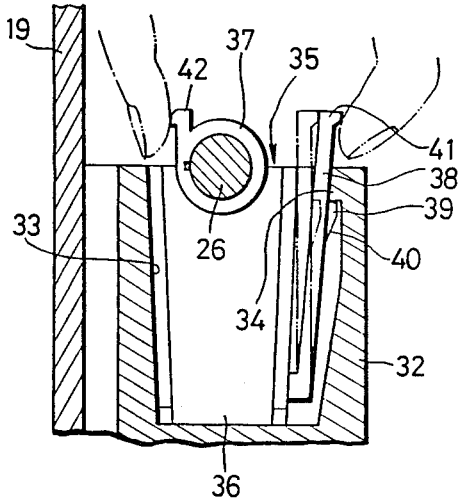
Figure 4:
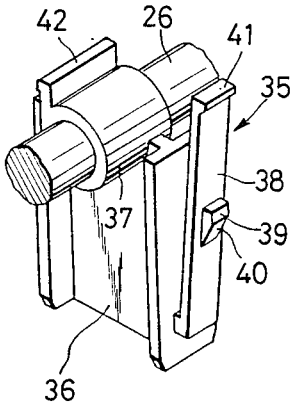
Figure 5:
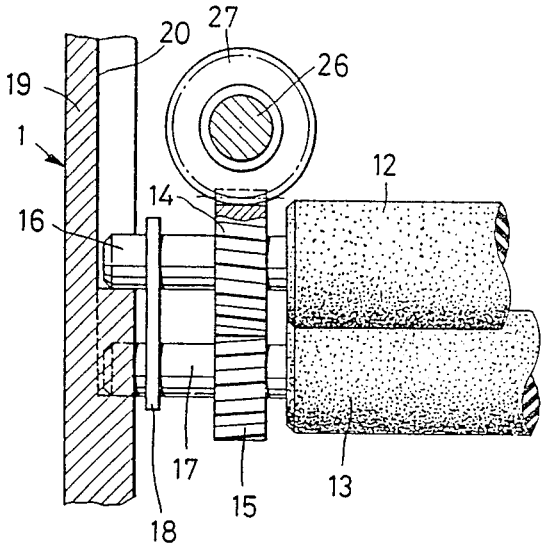

FIG. 1 shows a film processor apparatus wherein a tank assembly 1 includes a developing zone 2 for developing an exposed but unprocessed film fed to an upper portion thereof. On one side of the tank body 1, a hood 3 designed to light-tightly cover the upper portion thereof is rotatably supported by means of a pin 4. Within the hood 3, there is located a drying zone 5 for drying the film processed in the developing zone 2.

The develping zone 2 is divided into a developing tank 6, a fixing tank 7 and a rinsing tank 8 by partitions 9 and 9, as viewed from left to right in FIG. 1. Above the partitions 9 and 9 between the respective processing tanks 6, 7 and 8, there are guide plates 10 and 10 for guiding the delivery of an exposed film, which are curved downwardly. On th bottoms of the respective processing tanks 6, 7 and 8, there are guide means 11, 11 and 11, which are curved upwardly.

Each tank 6, 7 or 8 includes two sets of a pair of feed rollers 12 and 13. In the vicinity of the shaft ends of the feed rollers on one side thereof, there are fixedly provided gears 14 and 15. Sleeve-like bearings 16 and 17 are fitted over the shaft ends of the feed rollers 12 and 13 on both sides thereof, and the adjacent bearings 16 and 17 are connected to each other by a connector plate 18 to keep both gears 14 and 15 constantly engaged with each other and bring them into engagement within an elongate groove 20 formed on the inside of a side wall 19 of the tank assembly 1 for the respective processing tanks 6, 7 and 8.

Above the feed rollers 12 and 13 positioned on the outlet side of the rinsing tank 8, there is provided a guide plate 21 for guiding the processed film into the drying zone.

On the other hand, the drying zone 5 defined within the hood 3 includes a pair of blowers 22 and 22 for drying the exposed film which has been processed through the respective tanks 6, 7 and 8, plural pairs of feed rollers 24 for feeding out said film through a discharge hole 23 in the hood 3, and guide plates 25 interposed between said feed rollers 24.

At a position located above the gears 14 of the upper rollers 12 of the plural pairs of feed rollers 12 and 13, a driving shaft 26 extends in the direction that is horizontal but at right angles with respect to said feed rollers 12 and 13. The driving shaft 26 is fixedly provided with a plurality of worm gears 27 adapted to mate with the gears 14 of the respective upper rollers 12. The driving shaft 26 is also provided at one end with a gear 28, which is adapted to mate with a gear 31 secured to the end of an output shaft 30 of a motor 29 built in the tank assembly 1. Rotation of the motor 29 causes rotation of the shaft 26, thereby rotating the feed rollers 12 and 13 through the worm gear 27 and the gears 14 and 15.

On inner walls of the developing and rinsing tanks 6 and 8 of the tank assembly 1, there are bearing-supporting portions 32 and 32. Each portion 32 includes a hole 33 through which the bearing is inserted, and a stopper portion 34 by which the bearing is locked in place.

On the other hand, bearing members 35 and 35 are fitted over the driving shaft 26 so as to rotatably support it. Each bearing member 35 includes a portion 36 to be inserted into the aforesaid hole 33 in the aforesaid bearing-supporting portion 32 and a bearing portion 37 for rotatably supporting the driving shaft 26 which is integrally located on an upper portion of said portion 36 to be inserted. On one side of said portion 36, there is a resilient locking piece 38, which includes on its outer face a projecting portion 39 to engage the aforesaid stopper portion 34, said projection portion 39 having a tapered lower face 40. On an upper end of the resilient locking piece 38, there is a knob piece 41. The aforesaid bearing portion 37 is also provided with knob piece 42.

Accordingly, where the driving shaft 26 is incorporated into the tank assembly 1, the portion 36 of the bearing member 35 fitted thereover is inserted into the hole 33 in the bearing-supporting portion 32, whereupon the resilient locking piece 38 is inserted into the hole 33, while it is inwardly biased. After assembling, the resilient locking piece 38 is forced back under the action of a resilient force, so that the projecting portion 39 is locked by the stopper portion 34. Thus, the driving shaft 26 is rotatably incorporated into the tank assembly 1.

In order to remove the driving shaft 26 from within the tank assembly 1, the projecting portion 39 of the resilient locking piece 38 is disengaged from the stopper portion 34 of the hole 33 with the piece 42 of the bearing-supporting portion 32, and is then pulled up to separate, together with the driving shaft 26, the bearing member 35 from the bearing-supporting portion 32. Thus, for the purpose of maintenance, replacement, etc. of the feed rollers 12 and 13, the driving shaft 26, positioned above the feed rollers 12 and 13, is easily removed from the tank assembly 1 for attachment or detachment thereof.

Figure 6:
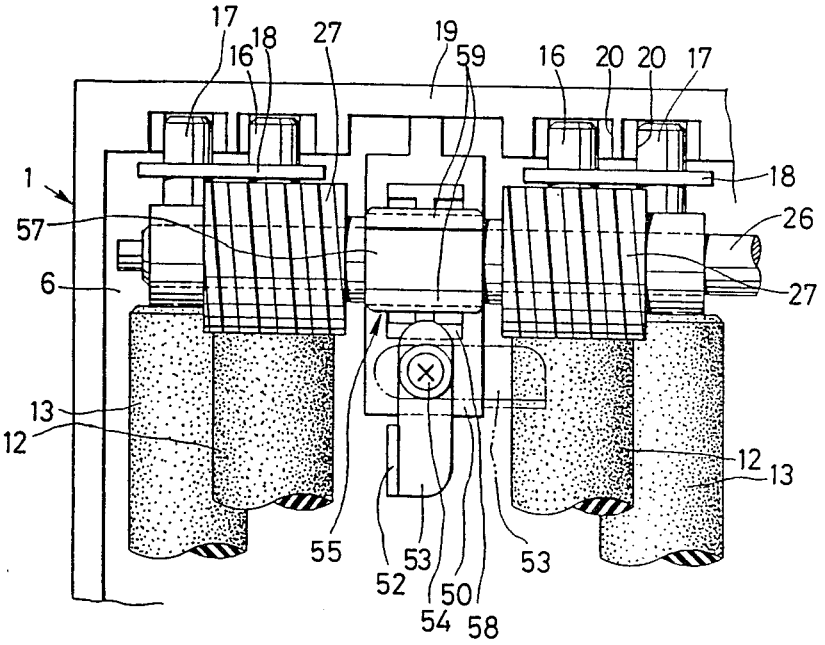
FIGS. 6 to 8 show the second embodiment of the present invention, FIG. 6 being a partial plan view showing the tank assembly, FIG. 7 being a sectioned side view showing the bearing device, and FIG. 8 being a perspective view showing the bearing device.
Figure 7:
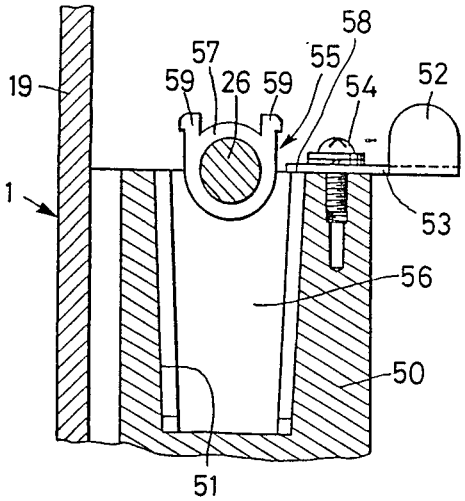
Figure 8:
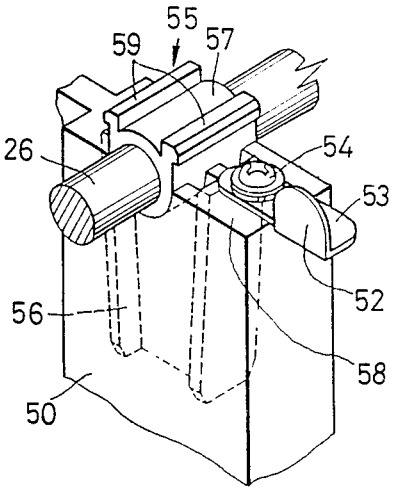

The second embodiment of the present invention will then be explained with referece to FIGS. 6 to 8.

According to this embodiment, a bearing-supporting portion 50, positioned in the developing and rinsing tanks 6 and 8, is formed therein with a hole 51 through which the bearing is inserted, and a locking lever 53 having a knob portion 52 is pivotally supported on an upper face of said portion 50 by means of shaft 54.

On the other hand, a bearing member 55 for rotatably supporting the driving shaft 26 includes a portion 56 to be inserted into the aforesaid hole 51 and a bearing portion 57 made integral with an upper face of said portion 56. An upper face of the aforesaid portion 56 then serves as a locking portion 58. The bearing portion 57 is also provided with a pair of knob pieces 59 and 59.

Accordingly, where the driving shaft 26 is assembled to the bearing-supporting portion 50, the locking lever 53 is positioned in parallel with the driving shaft 26, as illustrated by a dotted line in FIG. 6, to insert the portion 56 of the bearing member 55 into the associated hole 51 in the bearing-supporting portion 50. Then, the locking lever 53 is turned 90° into locking engagement with the locking portion 58, as shown by a solid line in FIG. 6.

When removing the driving shaft 26, the locking lever 53 is turned to disengage it from the associated locking portion, and is pulled up with the knob pieces 59 and 59. In this manner, the driving shaft 26 can easily be removed.

The third embodiment of the present invention will be explained with reference to FIGS. 9 and 10.

According to this embodiment, a bearing-supporting portion 60, located in the developing and rinsing tanks 6 and 8, is stepped on its upper face to define upper and lower step portions 61 and 62. A locking lever 53 having knob piece 52 is pivotally supported on the upper step portion 61 by means of a supporting shaft 54, and a groove 63 is formed on the lower step portion 62. The side wall 19 of the tank body 1 is formed with a locking projective piece 64, which is in the hooked form.

On the other hand, a bearing member 65 for rotatably supporting the driving shaft 26 includes a seat plate 66 which is integrally provided with a bearing portion 67 on its upper face and has at one end an upward locking portion 68 to engage the locking projecting piece 64 and at the other end a downward locking portion 69 to engage within the groove 63.

Figure 9:
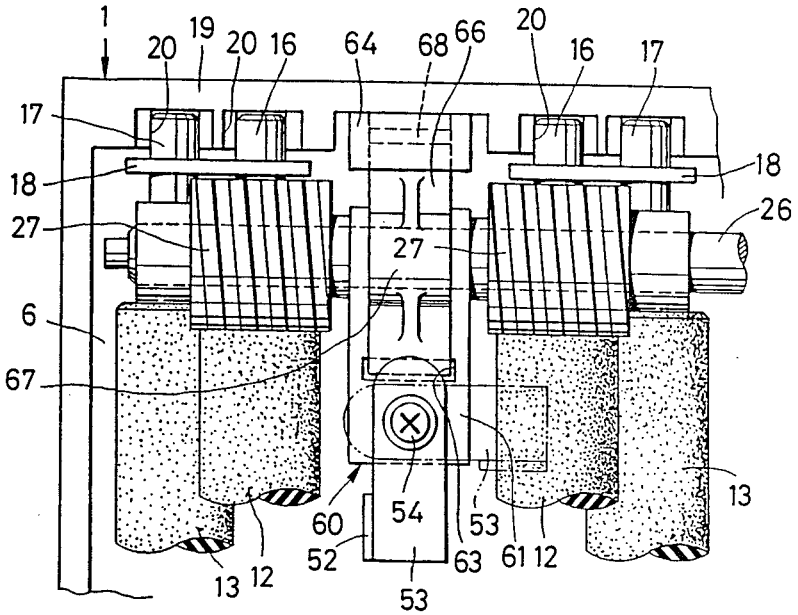
FIGS. 9 and 10 show the third embodiment of the present invention, FIG. 9 being a partial plan view showing the tank assembly, and FIG. 10 being a sectioned side view showing the bearing device.
Figure 10:
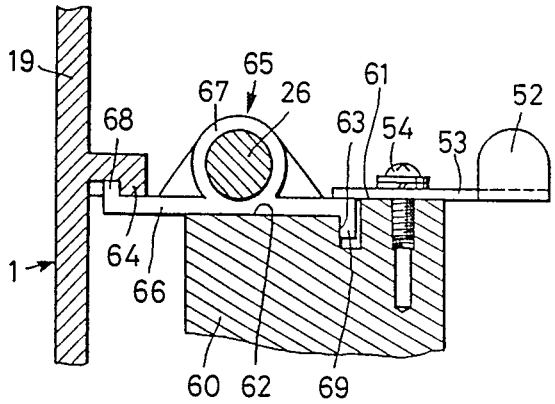

Accordingly, where the driving shaft 26 is assembled to the bearing-supporting portion 60, the locking lever 53 is positioned in parallel with the driving shaft 26, as shown by a dotted line in FIG. 9, to engage the locking portion 68 provided at one end of the bearing member 65 with the locking projecting piece 64 of the side wall 19 and engage the locking portion 60 at the other end within the groove 63, whereby the seat plate 66 is placed upon the lower step portion 62 of the bearing-supporting portion 60. Subsequently, the locking lever 53 is turned into the position shown by a solid line in FIG. 9 to engage it with the upper face of the seat plate 66 of the bearing member 65, whereby the bearing member 65 is assembled to the bearing-supporting portion 60.

When removing the bearing member 65, the locking lever 53 is turned to disengage it from the bearing member 65, and is then pulled up. In this manner, it is possible to easily remove the bearing member 65 from the bearing-supporting portion 60.

Figure 11:
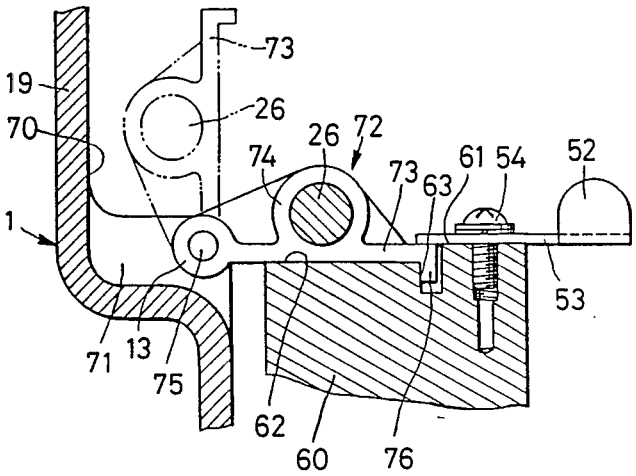
FIG. 11 is a sectioned plan view of the bearing device according to the fourth embodiment of the present invention.

The fourth embodiment of the present invention will be explained with reference to FIG. 11.

It is noted that, in this embodiment, the bearing-supporting portion 60 and locking lever 53 are similar to those used in the third embodiment explained with reference to FIGS. 10 and 11.

An upper portion of the side wall 19 of the tank assembly 1 is allowed to project outwardly and thereby define an escape portion 70, in which a supporting wall 71 is provided.

A bearing member 72 for rotatably supporting the driving shaft 26 includes a seat plate 73 which is integrally provided with a bearing portion 74 on its upper portion. The seat plate 73 has at one end a hinge 75 which is pivotally supported on the supporting wall 71 by means of a supporting shaft 75, and at the other end a downward locking portion 76 to engage within the groove 63 formed in the bearing-supporting portion 60.

Where the driving shaft 26 is assembled to the bearing-supporting portion 60, the bearing member 72 is turned around the hinge 75 to engage the locking portion 76 within the groove 63 in the bearing-supporting portion 60, whereby the seat plate 73 is laid upon the lower step portion 62 of the bearing-supporting portion 60. Then, the locking lever 53 is turned to engage the bearing member 72 with the upper face of the seat plate 73, whereby the bearing member 72 is assembled to the bearing-supporting portion 60.

For the purpose of maintenance, etc., the locking lever 53 is turned to disengage it from the bearing member 72, and the bearing member 72 is turned around the hinge 75 to bring the driving shaft 26 within the escape portion 70.

The fifth embodiment of the present invention will be explained with reference to FIG. 12.

According to this embodiment, an end wall of the developing tank 6 is stepped at 81 on its upper face 80 to define a bearing-supporting portion 82, and a locking lever 53 having a knob piece 52 is pivotally supported on the aforesaid upper face 80 by means of a supporting shaft 54.

Referring to the driving shaft 26, on the other hand, its shaft end located on the side of the rinsing tank 8 is fitted into a bearing member 84 rotatably supported on the tank assembly 1 by means of a supporting shaft 83, and its shaft end located on the side of the developing tank 6 is fitted into a bearing member 86 having a locking piece 85. In the vicinity of the shaft end of the driving shaft 26 located on the side of the rinsing tank 8, there is fixedly provided a gear 87, which mates with a gear 91 secured to an output shaft 90 of motor 89 fixedly attached to bracket 88 mounted on the tank assembly 1.

Figure 12:
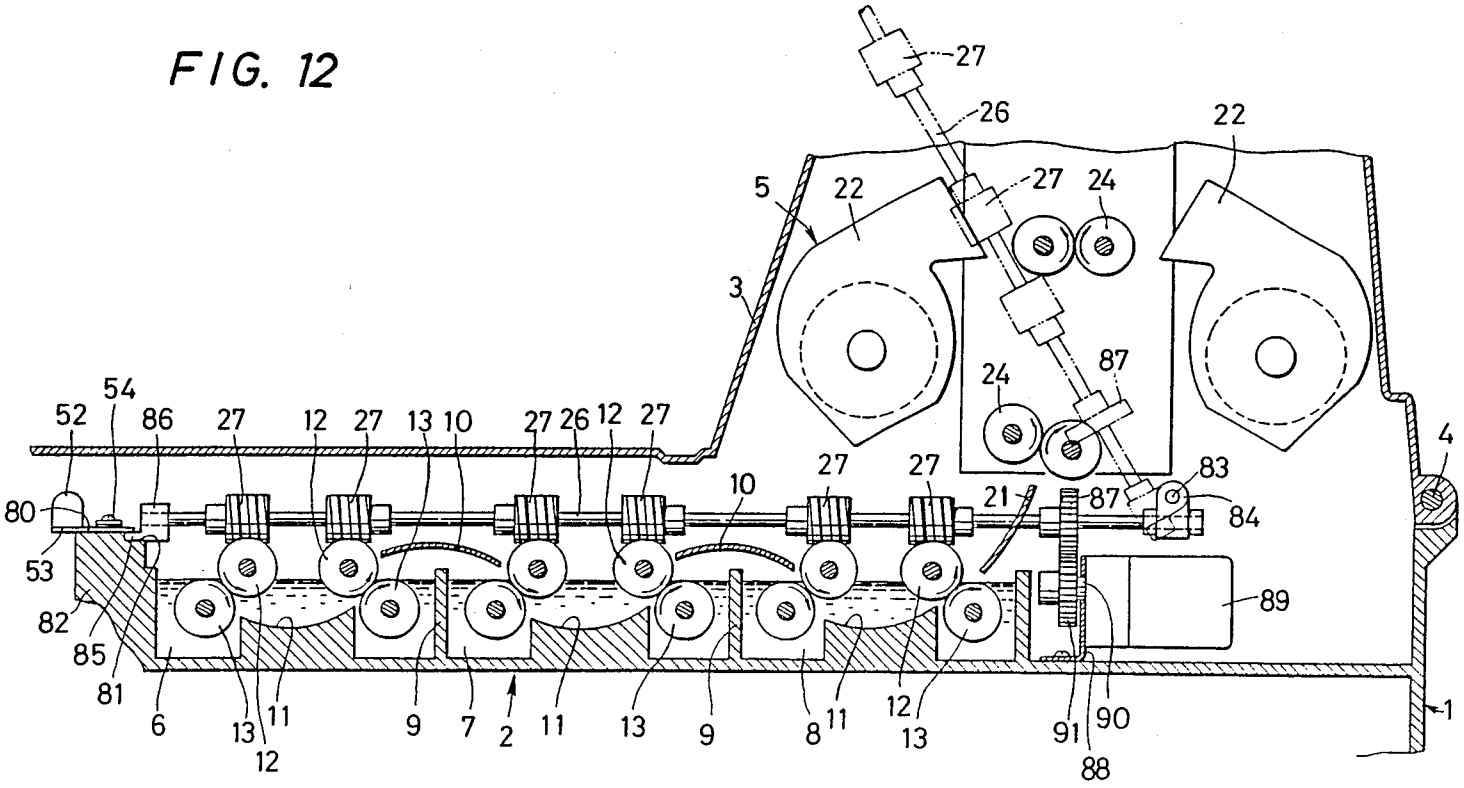
FIG. 12 is a sectioned front view showing part of the film processor apparatus according to the fifth embodiment of the present invention.

When the driving shaft 26 is assembled to the tank assembly 1, the driving shaft 26 is turned around the supporting shaft 83 from the position shown by a dotted line to the position shown by a solid line in FIG. 12 to lay the locking piece 85 of the bearing member 86 on the stepped portion 81 of the bearing-supporting portion 82 of the developing tank 6 and engage the worm gears 27 of the driving shaft 26 with the gears 14 of the respective upper feed rollers 12. Then, the locking lever 53 is turned for engagement with the locking piece 85 of the bearing member 86, whereby the bearing member 86 is assembled to the bearing-supporting portion 82.

For the purpose of maintenace, etc., after opening of the hood 3, the locking lever 53 is turned to disengage it from the bearing member 86, and the driving shaft 26 is turned around the supporting shaft 83 from the position shown by the solid line to the position shown by the dotted line in FIG. 12. Then, the driving shaft 26 disengages the upper portions of the plural pairs of feed rollers 12 and 13, so that attachement or detachment of the rollers 12 and 13 can easily be carried out.

The present invention will be explained with reference to the sixth embodiment illustrated in FIG. 13.

According to this embodiment, in the vicinity of the shaft end of the driving shaft 26 located on the side of the rinsing tank 8, that shaft is divided into first and second shaft portions **26*a* and 26*b*, respectively, which are rotatably connected to each other by means of a supporting shaft 100. The end of the first shaft 26*a* is fitted into bearings 101 and 101 secured to the tank assembly 1 and, in the vicinity thereof, there is fixedly provided a gear 87 to mate with a gear 91 of a motor 89. The end of the second shaft 26*b* is also provided with a bearing member 86, which is locked by means of a locking lever 53 on the bearing-supporting portion 82 formed on the end wall of the developing tank 6**.

Figure 13:
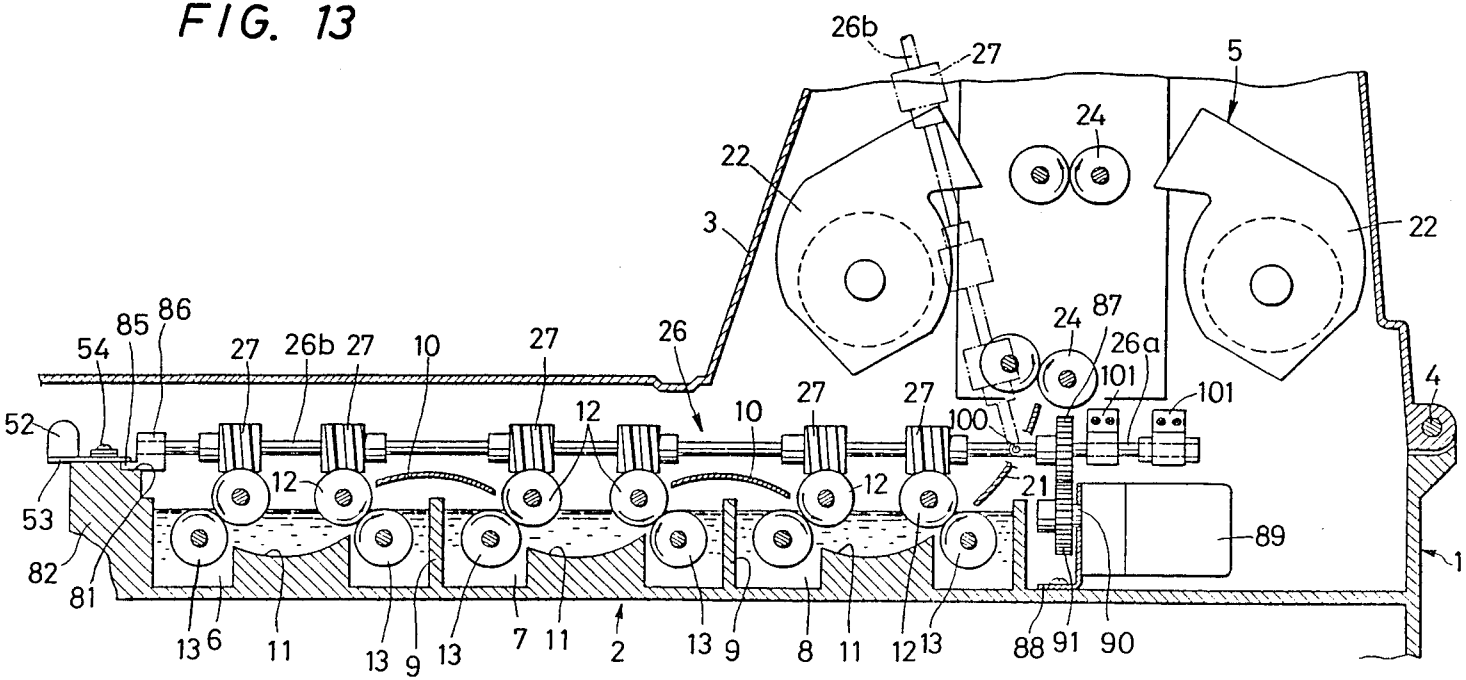
FIG. 13 is a sectioned front view showing part of the film processor apparatus according to the sixth embodiment of the present invention.

Accordingly, when the driving shaft 26 is assembled to the tank assembly 1, the second shaft **26*b* of the driving shaft 26 is turned around the supporting shaft 100 from the position shown by a dotted line to the position shown by a solid line in FIG. 13 to lay the locking piece 85 of the bearing member 86 upon the stepped portion 81 of the bearing-supporting portion 82 of the developing tank 6. Then, the locking lever 53 is turned to engage it with the locking piece 85 of the bearing member 86**.

For the purpose of maintenace, etc., the locking lever 53 is turned to disengage it from the locking piece 85 in the same manner as in the fifth embodiment, and the second shaft **26*b* of the driving shaft 26 is then turned around the supporting shaft 100 into the position shown by the dotted line in FIG. 13** to bring it in an upper position.

The present invention will be explained with reference to the seventh embodiment illustrated in FIGS. 14 and 15.

According to this embodiment, the end of the driving shaft 26 located on the side of the rinsing tank 8 is fitted into a bearing member 101 secured to the tank assembly 1, and the end of the driving shaft 26 located on the side of the developing tank 6 is fitted into a bearing member 110, which has locking portions 112 and 112 on both its lower wings.

On the other hand, a bearing holder 114 for detachably locking the bearing member 110 in place is fixedly provided onto an upper face of a bearing-supporting portion 113 formed on an end wall of the developing tank 6. The holder 114 is provided to slide the bearing member 110 in the axial direction of the driving shaft 26 for its attachement or detachment, and includes a pair of keep members 115 and 115 fixedly provided by means of screws 116 and 116, which are provided to lock the locking portions 112 and 112 on the upper face of the bearing member 113.

Figures 14, 15:
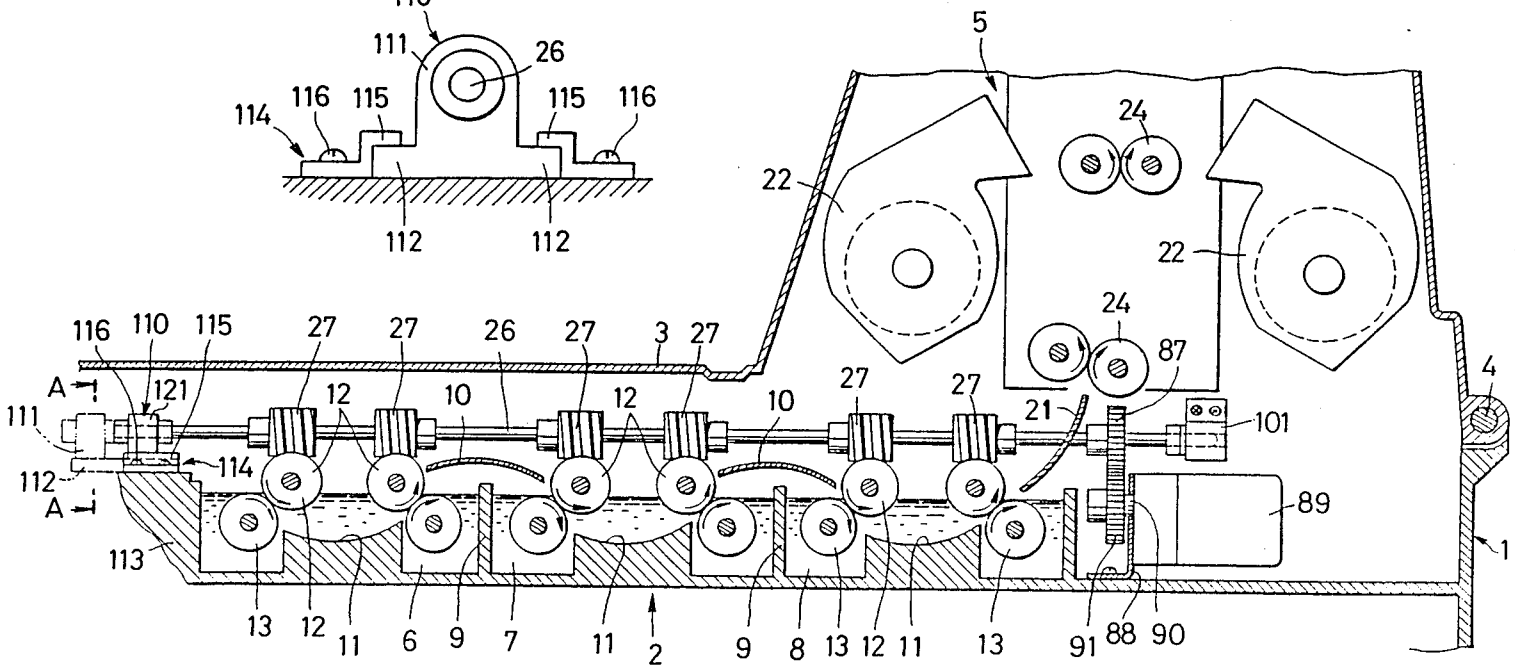
FIGS. 14 and 15 show the seventh embodiment of the present invention, FIG. 14 being a sectioned front view showing part of the film processor apparatus, and FIG. 15 being a sectional view taken along the line A—A of FIG. 14.

Accordingly, when the driving shaft 26 is assembled to the tank body 1, the bearing member 110 is fitted over the end of the driving shaft 26 located on the side of the developing tank 6, and the driving shaft 26 is moved from the lefthand to the righthand direction in FIG. 14 to fit the end thereof located on the side of the rinsing tank 8 into the bearing member 101 and insert and hold the bearing member into and within the bearing holder 114, whereby the gear 87 is engaged with the gear 91 of the motor 89, and the worm gear 27 is engaged with the associated gear 14 of the upper feed roller 12.

For the purpose of maintenance, etc., the driving shaft 26 is moved lefthand to disengage it from the bearing holder 114 of the bearing member 110 and pull the end of the driving shaft 26, located on the side of the rinsing tank 8, out of the bearing member 101, thereby removing the driving shaft 26 from the tank assembly 1.

Figure 16:
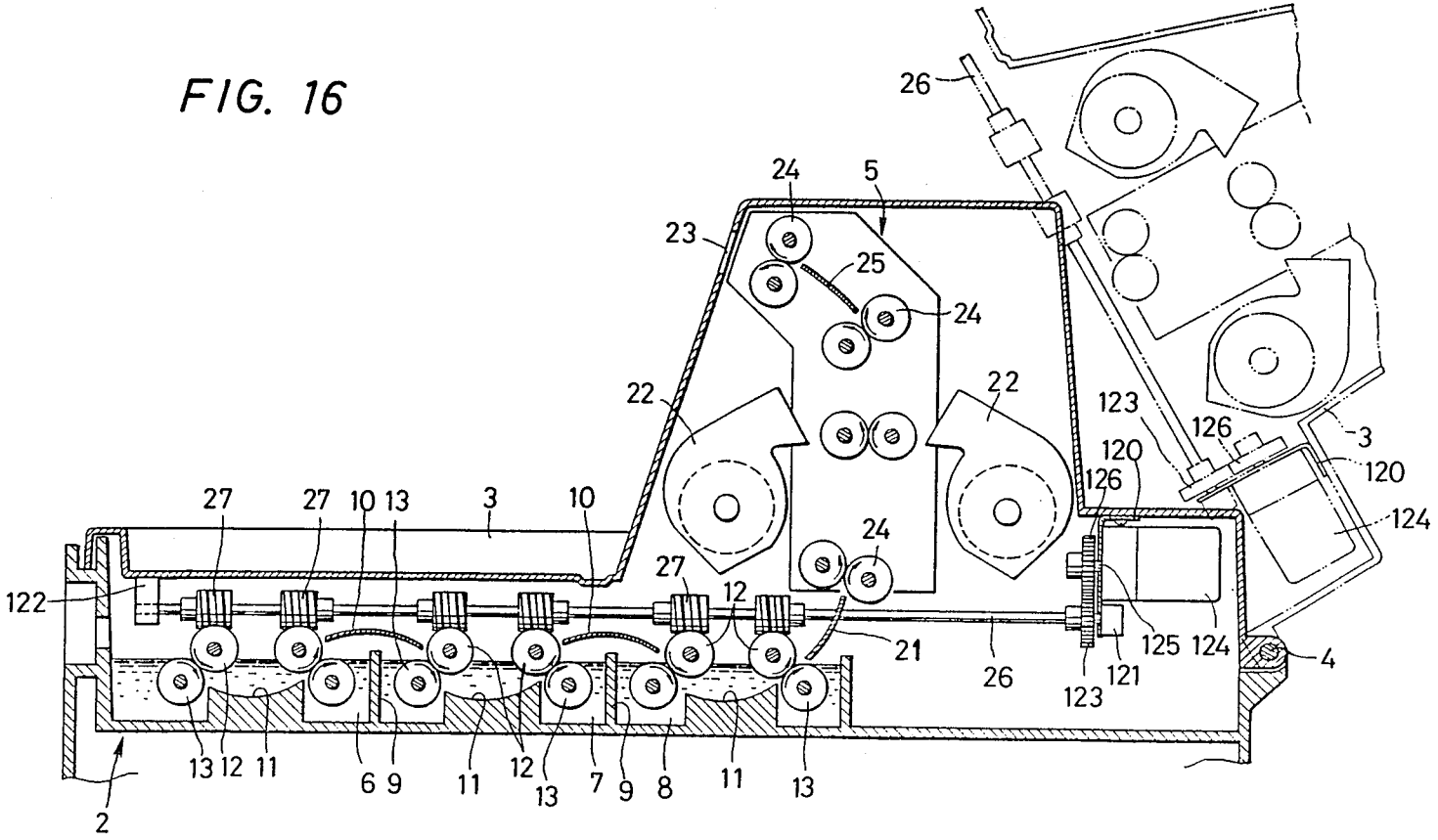
FIG. 16 is a sectioned front view showing part of the film processor apparatus according to the eighth embodiment of the present invention.

The present invention will be explained with reference to the eighth embodiment illustrated in FIG. 16.

According to this embodiment, the hood 3 is provided on its inside with a downwardly extending bracket 120, to which a bearing member 120 is secured. On the other inside of the hood 3 and above the developing tank 6, there is also fixedly provided a bearing member 122. Then, the driving shaft 26 is fitted at one end located on the side of the rinsing tank 8 with the bearing member 121 and at the other end located on the side of the developing tank 6 with the bearing member 122, respectively.

Furthermore, a gear 123 is secured to a portion of the driving shaft 26 in the vicinity of the bracket 120, and is engaged with a gear 126 secured to an output shaft 125 of a motor 124 fixed to the bracket 120.

Accordingly, the hood 3 is turned around the pin 4 to cover the tank assembly 1, whereupon the worm gear 27 of the driving shaft 26 is engaged with the gear 14 of the upper feed roller 12.

Then, upon the hood 3 being opened around the pin 4, the driving shaft 26 is shifted upwardly together with the hood 3.

Figure 17:
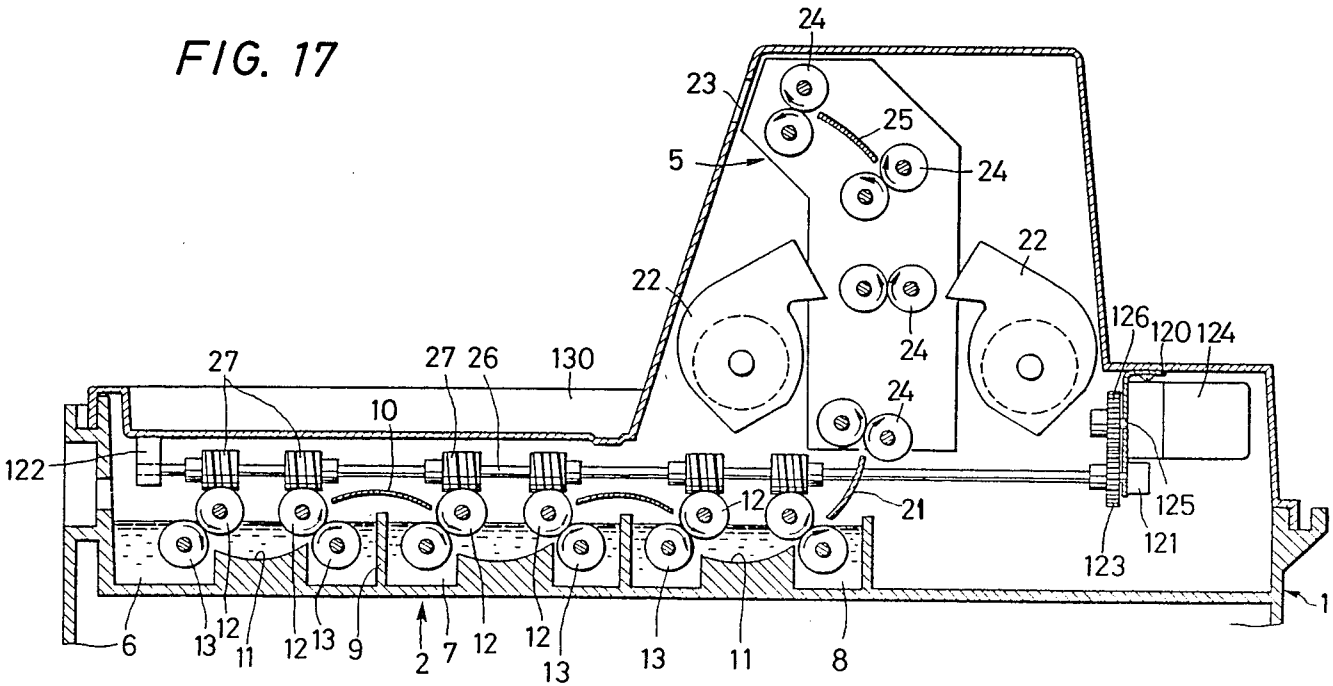
FIG. 17 is a sectioned front view showing part of the film processor apparatus according to the ninth embodiment of the present invention.

The present invention will now be described with reference to the ninth embodiment illustrated in FIG. 17.

This embodiment is essentially identical with the eighth embodiment illustrated in FIG. 15, except that a hood 130 for covering the upper face of the tank assembly 1 is attached with respect to the tank body 1.

Therefore, by covering the tank assembly 1 with the hood 130, the respective worm gears 27 of the driving shaft 26 are engaged with the gears 14 of the respective upper feed rollers 12 and, by removing the hood 130 from the tank assembly 1, the driving shaft 26 is removed from above the tank assebly 1 together with the hood 130.

As can be understood from the foregoing embodiments, since the present invention makes it possible to easily attach or detach the driving shaft 26 onto or from the respective processing tanks 6, 7 and 8, the maintenance, replacement, etc. of the feed rollers 12 and 13 can be carried out with improved workability.

It is understood that while the present invention has been described with reference to the foregoing embodiments, many modifications may be made without departing from the spirit and scope of the present invention.

We claim:

1. Apparatus, including a tank assembly, for processing exposed film, comprising:

a plurality of processing tanks adapted to contain a processing liquid;

a plurality of pairs of rollers mounted in said tank assembly for continuously passing an exposed film through said processing tanks, substantially each of said pairs of rollers having an upper roller and a lower roller and substantially each said upper roller having an end shaft provided with a gear; and a driving shaft which extends above the upper rollers of said pairs of rollers and generally at right angles with respect thereto, said driving shaft having worm gears in engagement with an uppermost portion of substantially each of said gears on said end shafts, and a first bearing member detachably mounted to said tank assembly wherein said driving shaft is rotatably supported by said first bearing member.

2. The apparatus as recited in claim 1, further including a bearing-supporting portion having a hole formed in a tank wall of said tank assembly and a stopper portion formed on an inner wall of said hole, said first bearing member including an inserting portion to be inserted into said hole, a bearing portion integrally provided on said inserting portion, a resilient locking piece integrally provided on one side of said inserting portion and resiliently locked on said stopper portion.

3. The apparatus as recited in claim 1, further including a bearing-supporting portion formed in said tank assembly, a locking lever movably supported on said bearing-supporting portion, said first bearing member including an inserting portion received in said bearing-supporting portion and a locking portion integrally provided on said inserting portion to be engaged with said locking lever.

4. The apparatus as recited in claim 1, wherein a locking projective piece is formed on an inner wall of said tank assembly, a bearing-supporting portion having a groove is provided in said tank assembly, a locking lever being movably supported on said supporting portion, said first bearing member includes a seat plate, an upward locking portion integrally provided at one end of said seat plate to be engaged with said locking projective piece, a downward locking portion integrally provided at the other end of said seat plate to be engaged with said groove, and said first bearing member including a bearing portion integrally provided on said seat plate.

5. The apparatus as recited in claim 1, including a bearing-supporting portion having a groove provided in said tank assembly, and wherein said first bearing member includes a seat plate, a hinge portion integrally provided at one end of said seat plate to be rotatably secured to an inner wall of said tank assembly, a downward locking portion integrally provided at the other end of said seat plate to be engaged with said groove, and said bearing plate to be engaged with said groove, and said first bearing member including a bearing portion integrally provided on said seat plate.

6. The apparatus as recited in claim 1, wherein said driving shaft has a first end and a second end, said first end supported by said first bearing member, a locking lever movably supported on said tank assembly for receiving to lock said first bearing member therein, and a second bearing member rotatably supported in said tank assembly to support said second end.

7. The apparatus of claim 1, wherein said driving shaft includes first and second shaft portions and a supporting shaft rotatably connecting the first and second shaft portions together, the first shaft portion including a first end supported by the first bearing member, a locking lever movably supported by said tank assembly for engaging to lock said first bearing member to the tank assembly, and wherein the second shaft portion defines a second end of said driving shaft located opposite the first end and a second bearing member fixed to said tank assembly to support said second end, said first shaft portion being pivotal with respect to the second shaft portion about said supporting shaft.

8. The apparatus of claim 1, wherein said driving shaft has a first end supported by said first bearing member, means for slidably mounting said first bearing member to said tank assembly such that the first bearing member is slidable in the axial direction of the driving shaft, and a second bearing member fixed to said tank assembly for supporting a second end of the driving shaft located opposite the first end.

9. The apparatus of claim 1, further including a hood detachably mounted to said tank assembly, said first bearing member being fixed to said hood to rotatably support said driving shaft.

10. The apparatus of claim 1, further including a hood rotatably secured to said tank assembly, said driving shaft being rotatably supported on said hood by said first bearing member.

* * * * *